US008597132B2

(12) United States Patent
Brown et al.

(10) Patent No.: US 8,597,132 B2
(45) Date of Patent: Dec. 3, 2013

(54) PLAY SYSTEM ACCESSORY WITH SOUND MODULES

(75) Inventors: Patrick W. Brown, Auburn, OH (US); John R. Nottingham, Bratenahl, OH (US); John W. Spirk, Gates Mills, OH (US); Robert F. Soreo, Cleveland Heights, OH (US); Randall Lee Day, Lamar, MO (US); Daniel Ray Whyman, Lamar, MO (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 257 days.

(21) Appl. No.: 13/076,285

(22) Filed: Mar. 30, 2011

(65) Prior Publication Data

US 2011/0244972 A1 Oct. 6, 2011

Related U.S. Application Data

(60) Provisional application No. 61/319,004, filed on Mar. 30, 2010.

(51) Int. Cl.
*A63G 21/00* (2006.01)
*A63J 5/04* (2006.01)

(52) U.S. Cl.
USPC ..... 472/116; 472/64

(58) Field of Classification Search
USPC ..... 472/59, 61, 72, 74, 88, 90, 116, 117, 472/128, 129, 130; 104/53, 69, 70, 73; 446/175, 219, 298, 397
See application file for complete search history.

(56) References Cited

U.S. PATENT DOCUMENTS

| | | | | |
|---|---|---|---|---|
| 5,685,778 | A * | 11/1997 | Sheldon et al. | 472/43 |
| 6,375,578 | B1 * | 4/2002 | Briggs | 472/117 |
| 7,967,692 | B2 * | 6/2011 | Werner | 472/117 |
| 8,047,925 | B2 * | 11/2011 | Burgaard et al. | 472/118 |

FOREIGN PATENT DOCUMENTS

| | | | |
|---|---|---|---|
| EP | 1153637 | A2 | 11/2011 |
| JP | 03-254777 | A | 11/1991 |
| JP | 07222871 | A | 8/1995 |
| WO | 2006116176 | A2 | 11/2006 |

OTHER PUBLICATIONS

PCT Search Report and Written Opinion from PCT Application No. PCT/US2011/030597 entitled Play System Accessory With Sound Modules (Dated Mar. 30, 2011).

* cited by examiner

*Primary Examiner* — Kien Nguyen
(74) *Attorney, Agent, or Firm* — Hovey Williams LLP

(57) ABSTRACT

An accessory for a play system includes an elongated surface and a plurality of sound modules coupled with the elongated surface. The elongated surface may be a slide, climbing wall, ladder or any other surface across which a child may slide, crawl, or climb. The sound modules are spaced along a length of the elongated surface and are each configured to emit a unique sound when operated by the child while traversing the elongated surface.

9 Claims, 6 Drawing Sheets

PLAY SYSTEM ACCESSORY WITH SOUND MODULES

RELATED APPLICATIONS

The present application claims the priority benefit of U.S. Provisional Patent Application Ser. No. 61/319,004 entitled "SLIDING BOARD WITH SOUND," filed Mar. 30, 2010, the entire disclosure of which is incorporated herein by reference.

BACKGROUND

Swing sets and other play systems typically include a frame or other support structure and a number of play accessories such as slides, climbing walls, swings, etc. supported on or suspended from the support structure. Many of the play accessories allow children to slide, crawl, climb, or otherwise traverse across a surface while playing.

SUMMARY

Applicant has discovered that children's enjoyment of play accessories is enhanced when they receive sensory feedback of their movement across the accessories. Embodiments of the present invention take advantage of this discovery by providing a play system accessory that enables children to trigger sounds while traversing the accessory.

An embodiment of the present invention is an accessory for a play system that broadly comprises an elongated surface and a plurality of sound modules coupled with the elongated surface. The elongated surface is configured for supporting one or more children while playing on the play system and is configured to permit a child to slide, crawl, or climb across it. For example, the elongated surface may be a slide, a climbing wall, a ladder, or similar component.

The sound modules are spaced along a length of the elongated surface and are each configured to emit a sound when operated by a child. In one embodiment, each sound module comprises a speaker and a switch for triggering the speaker when the switch is operated by the child. In another embodiment, each sound module comprises a switch that is in communication with a central speaker or speakers that are coupled with all the sound modules. A child may press or otherwise operate the switches as he or she slides down the slide to trigger the speakers. In some embodiments, each sound module emits a unique sound so that a child can trigger a variety of different sounds while sliding down the slide.

In one embodiment, at least one of the sound modules may include a processor or other control device for controlling the sounds emitted by the sound modules. The control device may vary the sounds based on how many of the sound modules are operated by a child. For example, the control device may cause one or more of the sound modules to emit one sound if the switch of only one sound module is operated, another sound if the switches of two sound modules are operated, yet another sound if the switches of three sound modules are operated, etc. The control device may also vary the sounds based on how quickly successive sound modules are operated. For example, the volume of the sounds emitted by the sound modules may increase if a child rapidly operates the switches of multiple sound modules in succession. The control device may also vary the sounds based on the order in which the switches are operated. For example, the sound modules may emit one type of sound if the switches are operated from top to bottom (while a child slides down the slide) and another type of sound if the sound modules are operated from bottom to top (while a child crawls up the slide).

One or more of the sound modules may also comprise an input for receiving audio signals from an MP3 player or other external audio source. One or more of the sound modules may also comprise memory for storing a plurality of audio files and a selector switch for permitting a user to select which of the audio files is reproduced by the sound-emitting device.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
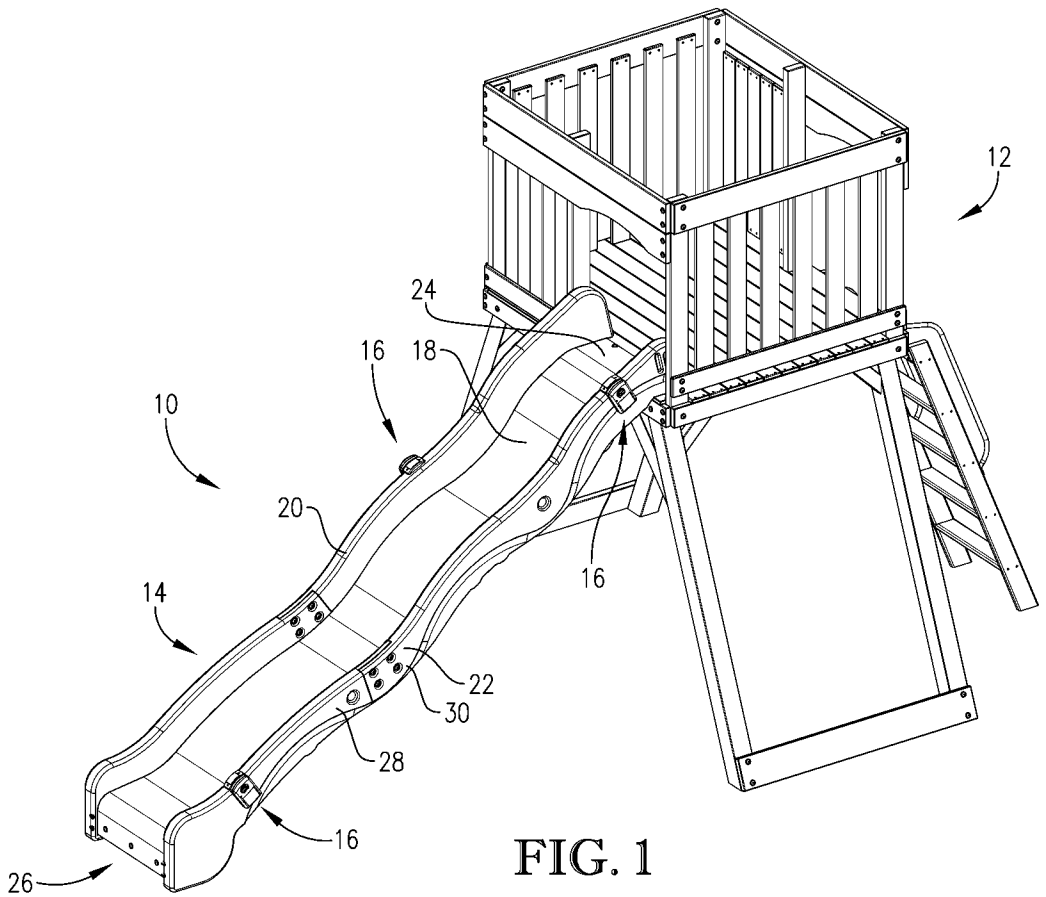
FIG. 1 is a perspective view of a play system accessory constructed in accordance with an embodiment of the invention and shown attached to an exemplary play system.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, and particularly FIG. 1, a play system accessory 10 constructed in accordance with an embodiment of the invention is illustrated. The accessory 10 may be attached to the frame or other support structure of a play system 12 and broadly comprises an elongated surface 14 and a plurality of sound modules 16 coupled with the elongated surface. Any number of play system accessories 10 may be suspended from and/or attached to the play system 12 or similar play system, but only one is illustrated and described herein for clarity.

The elongated surface 14 can be any device or object across which a child may slide, crawl, or climb. For example, the elongated surface may be a slide, a climbing wall, a ladder, or a similar component.

Figures 2, 3, 4:
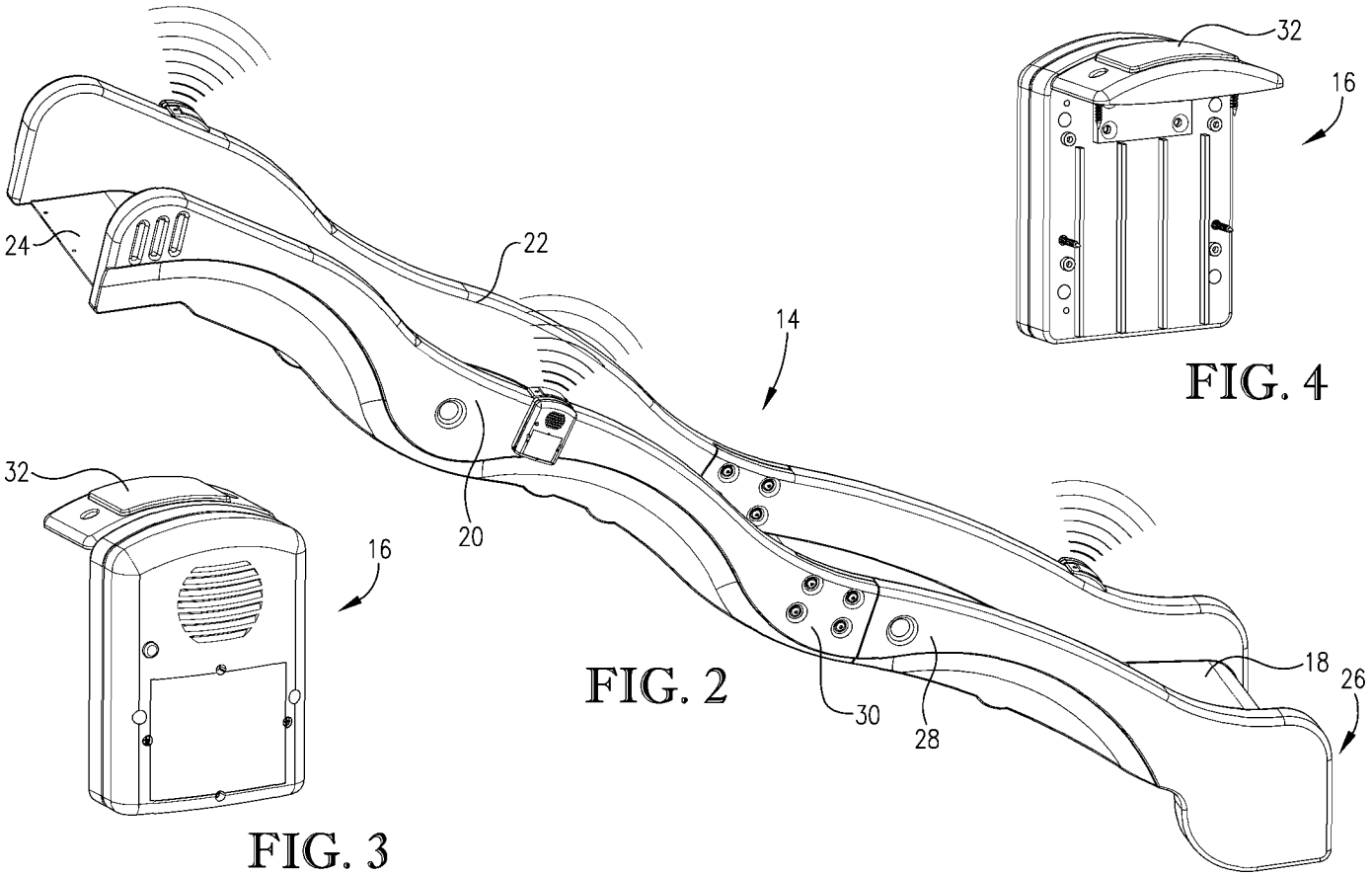
FIG. 2 is an enlarged perspective view of the play system accessory.
FIG. 3 is a front perspective view of one of the sound modules of the play system accessory.
FIG. 4 is a rear perspective view of one of the sound modules.

A particular embodiment of the elongated surface 14 is a slide as illustrated in FIGS. 1 and 2. The slide comprises a relatively smooth ramped surface 18 down which children may slide or crawl and a pair of upstanding sidewalls 20, 22 positioned on opposite sides of the ramped surface to keep the children from falling from the slide. The ramped surface 18 may be relatively planar or may be undulating or wavy as best illustrated in FIG. 2. One end 24 of the slide may be attached to the play system by screws, bolts, hooks, hangers, eyelets, or other fasteners and the other end 26 rests on the ground or other ground-level surface.

The slide may be formed of any suitable materials such as plastic or vinyl. In one embodiment, the slide is formed from a number of sections 28, 30 that are aligned end-to-end and bolted or otherwise attached together. An embodiment of the slide is approximately five (5) to ten (10) feet long, two (2) feet wide, and five (5) to seven (7) feet tall, although it can be of any size and shape without departing from the scope of the invention.

The sound modules 16 are attached to the slide and configured for producing sounds when operated by children playing on the slide. In one embodiment, the sound modules are spaced along the length of the slide sidewalls 20, 22 so that a child can easily operate them while sliding down the slide. For example, as depicted in FIG. 2, a first sound module may be positioned on one sidewall near the top of the slide so that a child may operate it when first entering the slide, a second sound module may be positioned on the opposite sidewall downhill from the first sound module, and a third sound module may be positioned on the same sidewall as the first sound module near the bottom of the slide so that the child may operate it as he or she exits the slide. FIG. 2 illustrates just one example of the placement and spacing of the sound modules, as any number of sound modules may be positioned anywhere on the slide without departing from the scope of the invention.

Figure 7:
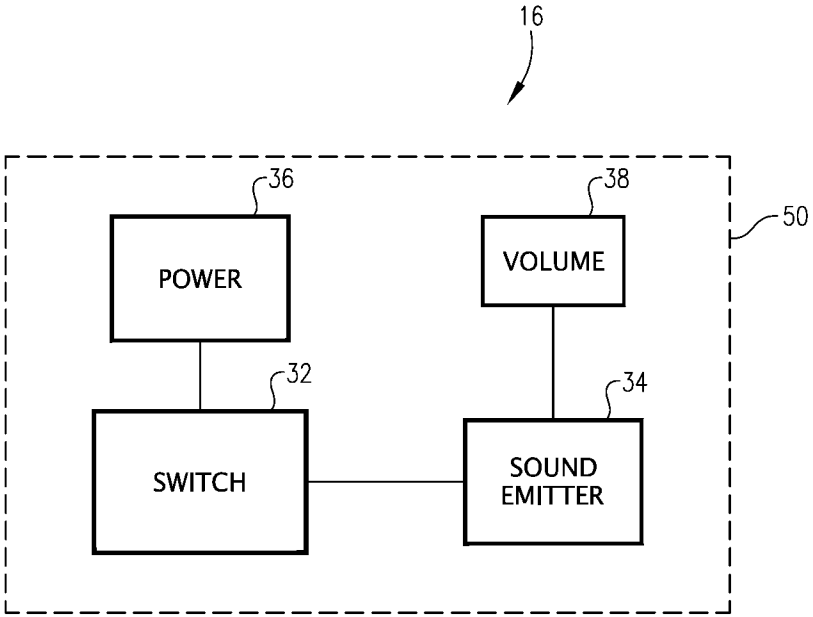
FIG. 7 is a block diagram of the primary components of a sound module constructed in accordance with an embodiment of the invention.

The sound modules 16 may include any powered components capable of producing sounds when activated by children. One embodiment of a sound module is illustrated in FIG. 7 and broadly comprises a switch 32, a sound-emitting device 34 for emitting sounds when activated by the switch, and a power source 36.

The switch 32 may be a push button switch, toggle switch, rocker switch, or any other device that allows a child to easily activate the sound-emitting device 34 while sliding down or otherwise traversing the slide. In one embodiment, the switch 32 of each sound module is mounted to the upper margin of one of the slide's sidewalls 20, 22 so it can be easily pressed or otherwise operated while sliding down the slide. Each switch may also be illuminated to be visible in low light environments.

The sound-emitting device 34 of each sound module reproduces sounds when activated by its switch 32 and may utilize any sound reproducing technology. For example, each sound-emitting device 34 may include a speaker diaphragm that is driven by a voice coil and magnet assembly and may have internal amplifiers and other driver circuitry. Each sound-emitting device may also be coupled with a conventional volume control switch 38 to permit volume adjustment of the device. In some embodiments, each of the sound modules emits a unique sound so that a child may trigger a variety of different sounds while traversing the slide. The sounds may include ringing sounds, horn sounds, music, voices, etc.

In other embodiments of the invention, some of the sound modules 16 may only comprise a switch that is coupled with a central speaker. When a child operates one of the switches, a signal is sent to the central speaker to emit a sound. The central speaker may be a stand-alone device mounted anywhere on or near the play system 12 or may be incorporated into one of the sound modules. In other words, some of the sound modules may only have a switch whereas others may have a switch and a speaker that acts as a central speaker for multiple sound modules. In these embodiments, the central speaker may still emit a unique sound when each switch is activated.

The power source 36 may include one or more batteries, a solar cell, an electrical terminal or contact for receiving power from an electricity source, or any other conventional power supply. Each sound module may have its own power source or one or more central power sources may power all the sound modules.

Figure 8:
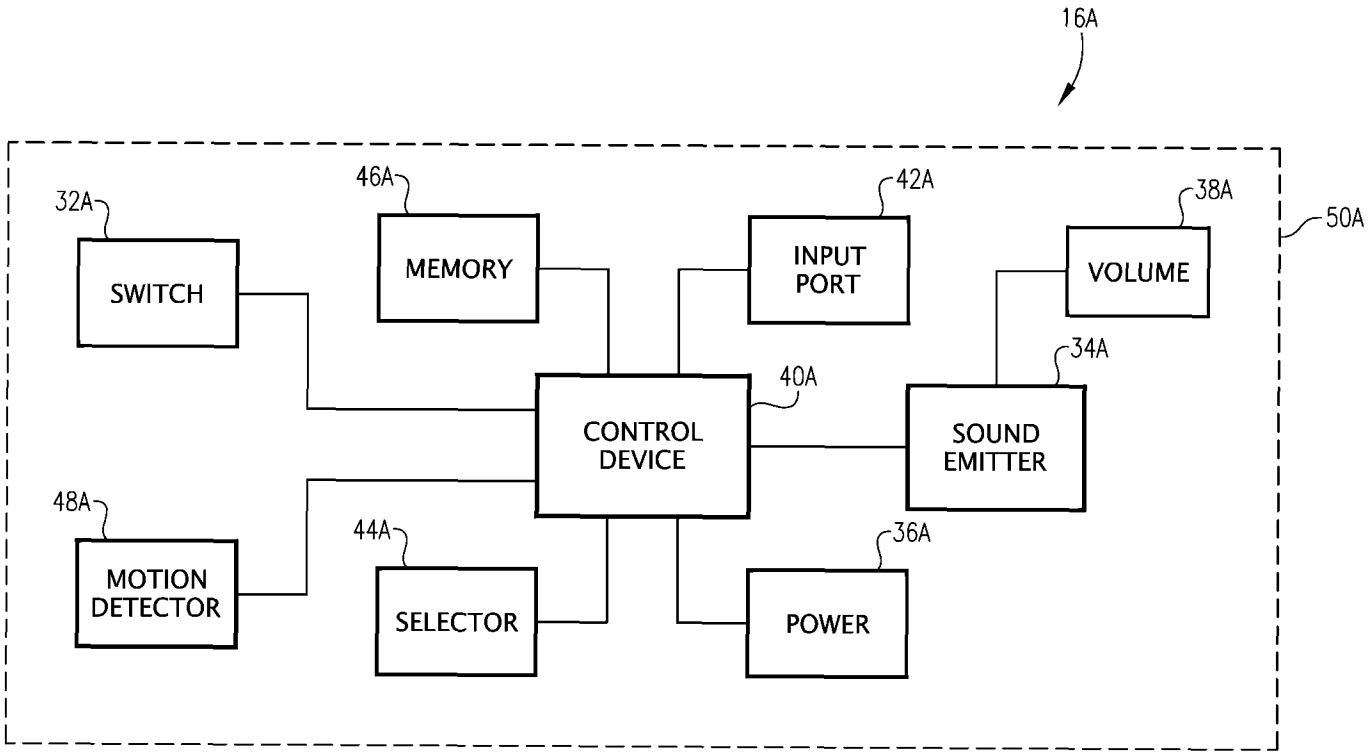
FIG. 8 is a block diagram of the primary components of a sound module constructed in accordance with another embodiment of the invention.

A sound module 16A constructed in accordance with another embodiment of the invention is depicted in FIG. 8. The sound module 16A includes a switch 32A, a sound-emitting device 34A, and a power source 36A all essentially identical to the like-numbered components described above. The sound module 16A also includes a control device 40A, an input port 42A, and a selector 44A.

The control device 40A is provided in some embodiments of the invention for receiving signals from its switch 32A and possibly other switches and controlling the sounds emitted by its sound-emitting device 34A in accordance with the signals. The control device 40A may include any number and type of processors, controllers, or other processing systems and may include resident or external memory 46A for storing audio files and other information accessed and/or generated by the sound module.

The control device 40A may implement one or more computer programs which control its sound-emitting device 34A and possibly other sound-emitting devices as described in more detail below. The computer programs may comprise ordered listings of executable instructions for implementing logical functions in the control device. The computer programs can be embodied in any computer-readable medium for use by or in connection with the control device or any other device that can fetch and execute the instructions.

As used herein, a "computer-readable medium" can be any means that can contain, store, communicate, propagate or transport computer programs. The computer-readable medium can be, for example, but not limited to, an electronic, magnetic, optical, electro-magnetic, infrared, or semi-conductor system, apparatus, device, or propagation medium.

More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). An embodiment of the computer-readable medium includes the memory.

The control device 40A may vary the type, volume, duration, frequency, or other characteristic of the sounds emitted by its sound-emitting devices 34A and possibly other sound-emitting devices based on a child's interaction with the play accessory. For example, the control device 40A may vary the sounds based on how many of the sound modules 16A are operated by a child. Specifically, the control device 40A may cause one or more of the sound modules 16A to emit one sound if the switch 32A of only one sound module is operated, another sound if the switches of two sound modules are operated, yet another sound if the switches of three sound modules are operated, etc. The type, volume, and/or frequencies of sounds emitted by the sound modules 16, 16A may also vary as a function of how quickly the switches are operated. For example, the volume of the sounds emitted by the sound modules 16A may increase if a child rapidly operates the switches of multiple sound modules in succession. The sounds may also vary based on the order in which the switches 32A are operated. For example, the sound modules 16A may emit one type of sound if the switches are operated from top to bottom (while a child slides down the slide) and another type of sound if the sound modules are operated from bottom to top (while a child crawls up the slide).

Each sound module 16A may include its own control device 40A, or only one sound module 16A may have a control device for receiving inputs from all the switches 32A and controlling activation of all the sound-emitting devices 34A. If each sound module includes a separate control device, the control devices may communicate with each other over a wired or wireless communication channel to synchronize operation of the various sound modules 16A.

The input port 42A may be provided for receiving audio signals from an MP3 player, radio, TV, computer or other external audio source for reproduction by one or more of the sound-emitting devices. Each sound module 16A may have such an input port, or only one may have one for delivering signals to all of the sound modules. Alternatively, one or more of the sound modules 16A may receive audio signals wirelessly via a Bluetooth connection or other wireless connection. In yet another embodiment, one or more of the sound modules 16A may include an internal or integral MP3 player, radio, or other audio source.

The selector 44A may be any switch, button, etc. that permits a user to provide an input instruction to the control device 40A. For example, the memory 46A may store a plurality of audio files, and the selector switch 44A may be operated by a user to select which of the audio files is reproduced by the sound-emitting device of that sound module when its switch is activated.

In other embodiments of the invention, one or more of the sound modules may also comprise a motion detector 48A as depicted in FIG. 8. The motion detector may be any device or components capable of detecting movement of the elongated surface 14 or movement of children on the surface. For example, the motion detector may incorporate one or more ball switches, accelerometers, levels, gyroscopes, or strain gauges for detecting motion of the support or more ultraviolet, ultrasonic, or other wave type sensors for detecting motion of children on the support.

In embodiments with a motion detector 48A, the control device 40A may vary the sounds emitted by the sound-emitting devices 34A based on sensed motion. For example, each control device 16A may instruct its sound-emitting device 34A to emit sounds when children slide down the slide, as detected by the motion detectors, even when the children don't activate the switch 32A. The control device 40A may also instruct the sound-emitting device to increase the volume and/or frequencies of sounds as children move rapidly down or up the slide and decrease the volume and/or frequencies of sounds as children move more slowly on the slide. This enables children to make different sounds by interacting in different ways with the slide.

Some of the sound modules 16A may also include one or more LEDs or other lights. The lights may illuminate when children operate the switches 32A and/or when the motion detectors 48A detect motion of the elongated surface or movement of children on the surface. Multi-colored LEDs and a selector switch may also be provided so that a user may choose the color, or colors, emitted by the LEDs.

Figure 5:
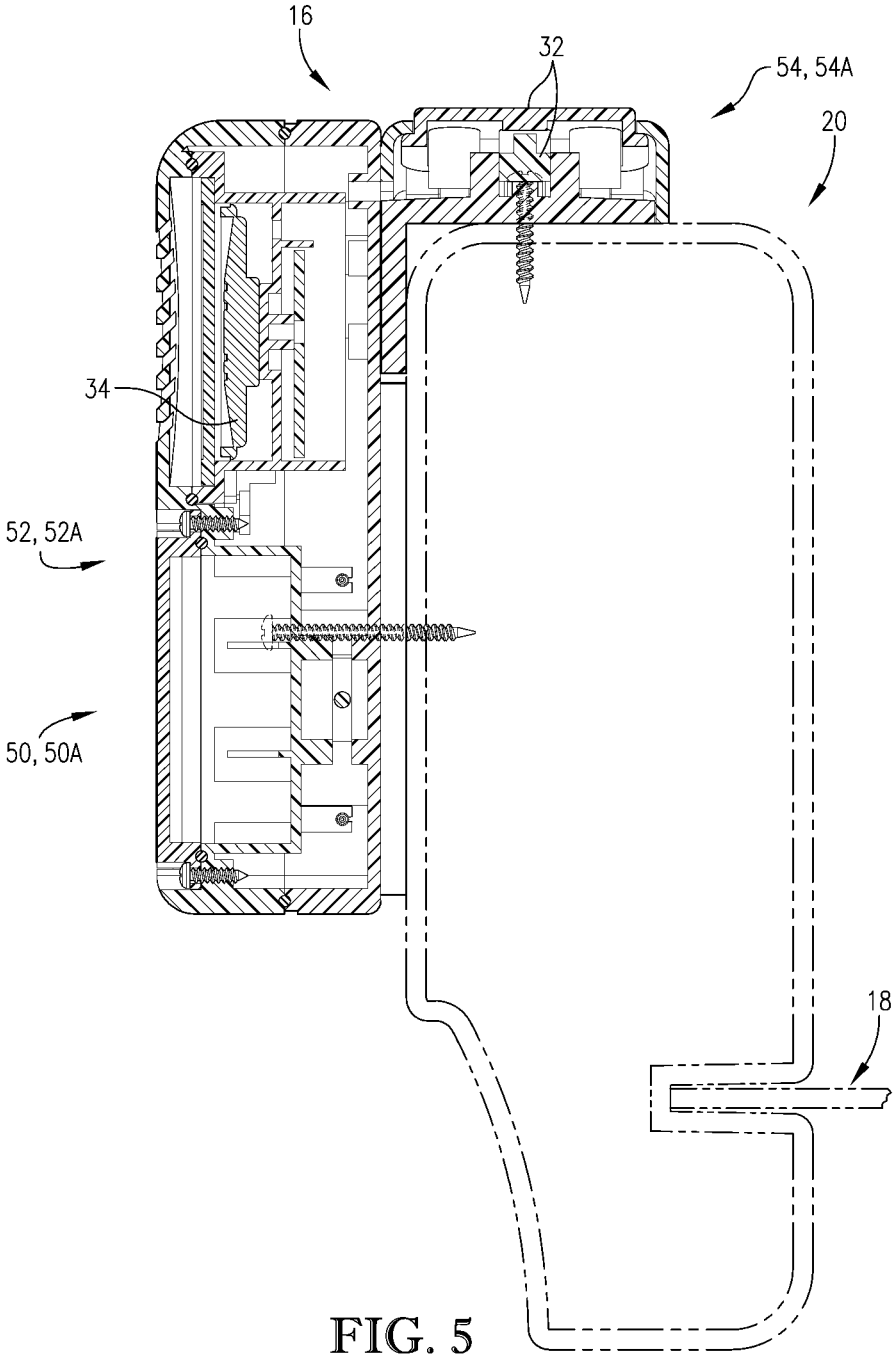
FIG. 5 is a vertical sectional view of one of the sound modules and a portion of the play system accessory.
Figure 6:
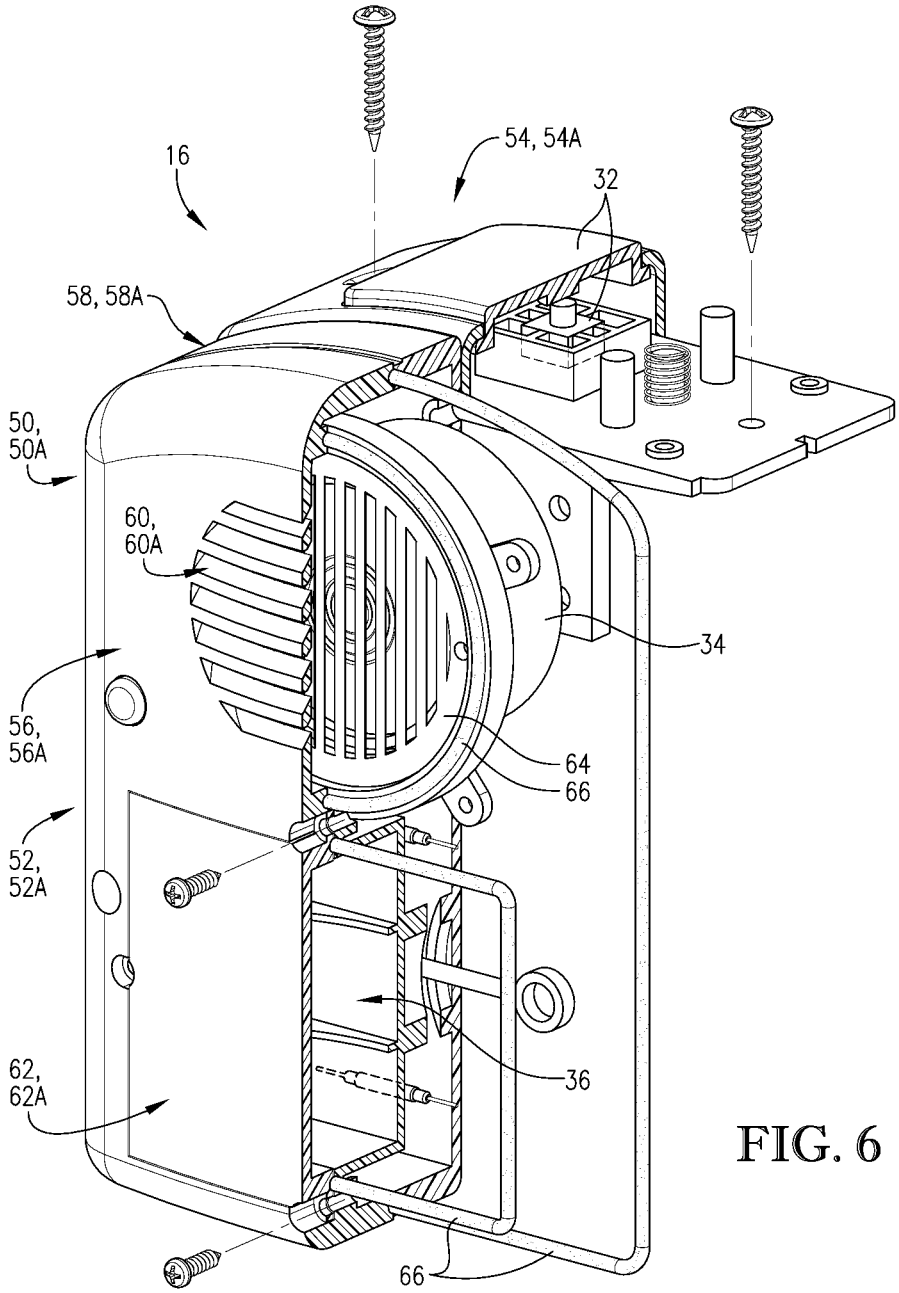
FIG. 6 is a fragmentary partial vertical sectional view of one of the sound modules.

The above-described components of the sound modules 16, 16A are preferably housed within a water proof or water resistant enclosure 50, 50A made of plastic or other suitable materials. As best illustrated in FIGS. 5 and 6, each enclosure may include a main portion 52, 52A for housing all of the components of the sound module except for the switch and secondary portion 54, 54A for supporting the switch. The main portion may include two halves 56, 56A and 58, 58A that can be separated to access the internal components, a slotted opening 60, 60A for directing sounds out of the enclosure, and a battery compartment 54 for holding the batteries or other power supplies. A baffle 64 is positioned between the speaker 34 and the slotted opening 60, 60A to resist migration of water into the enclosure. Gaskets, O-rings, or other seals 66 may be positioned around the electric components of the sound module to further resist migration of water into the enclosure. The secondary portion 54, 54A of each enclosure may be attached near the top of the main portion as illustrated for supporting its switch on the slide sidewall as described above. Both portions of the enclosure may be screwed, glued, or otherwise fastened to the slide as illustrated. In other embodiments, the components of the sound modules may be integrally formed with the slide or other elongated surface so that separate enclosures aren't needed.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

Having thus described the preferred embodiment of the invention, what is claimed as new and desired to be protected by Letters Patent includes the following:

1. A play system comprising:

a support structure; and a slide attached to the support structure, the slide comprising:

a relatively smooth ramped surface down which a child may slide;

a pair of upstanding sidewalls positioned on opposite sides of the ramped surface;

a plurality of sound modules spaced along each of the sidewalls, each sound module comprising a speaker and a switch for activating the speaker to emit a unique sound when the switch is activated; and a controller for communicating with each of the sound modules, performing an algorithm on an input from at least one of the sound modules, and instructing at least one of the speakers to emit a sound based on a result of the algorithm.

2. The play system as set forth in claim 1, wherein each sound module further comprises memory for storing a plurality of audio files and a selector switch for permitting a user to select which of the audio files is reproduced by the speaker when the switch is activated.

3. The play system as set forth in claim 1, wherein the sound module further comprises an input for receiving audio signals from an external audio source for reproduction by the speaker.

4. The play system as set forth in claim 1, wherein at least one of the sound modules is configured to emit a unique sound if a predetermined number of the sound modules are operated by the child.

5. The play system as set forth in claim 1, wherein at least one of the sound modules is configured to emit a unique sound if the sound modules are operated in a particular order by the child.

6. The play system as set forth in claim 1, wherein at least one of the sound modules is configured to emit a unique sound if a predetermined number of the sound modules are operated by the child within a prescribed time period.

7. The play system of claim 1, the controller being part of one of the sound modules;

wherein each of the other sound modules includes another controller.

8. The play system of claim 1, each of the controllers being operable to communicate with each of the other sound modules, perform an algorithm on an input from at least one of the other sound modules, and instruct at least one of the speakers to emit a sound based on a result of the algorithm.

9. A play system comprising:

a support structure; and a slide attached to the support structure, the slide comprising:

a relatively smooth ramped surface down which a child may slide;

a pair of upstanding sidewalls positioned on opposite sides of the ramped surface; and a plurality of sound modules spaced along each of the sidewalls, each sound module comprising a speaker, a switch for activating the speaker to emit a unique sound when the switch is activated, and a controller for communicating with a controller of another sound module, performing an algorithm on an input from the controller of the other sound module, and instructing the speaker to emit a sound based on a result of the algorithm, wherein the algorithm generates an output having a characteristic modifiable based on an order in which the switches were activated, a time period in which two switches were activated, and a number of switches activated, and the characteristic is selected from the group consisting of duration, volume, frequency, and type of sound.

* * * * *